United States Patent [19]

Frey et al.

[11] Patent Number: 4,645,790

[45] Date of Patent: Feb. 24, 1987

[54] CORROSION-RESISTANT LUBRICANT COATING COMPOSITE

[76] Inventors: Gary T. Frey, 566 Cedarbrook Dr., Painesville, Ohio 44077; Douglas H. Strong, 7466 Mountain Park Dr., Mentor, Ohio 44060; Janet B. Urbanski, 642 High St., Fairport Harbor, all of Ohio 44077

[21] Appl. No.: 769,542

[22] Filed: Aug. 26, 1985

Related U.S. Application Data

[62] Division of Ser. No. 595,055, Mar. 30, 1984, Pat. No. 4,555,445.

[51] Int. Cl.[4] ..... C08K 3/34; C08K 3/36; C08K 5/54; C08L 23/08

[52] U.S. Cl. ..... 524/442; 524/261; 524/443; 524/556; 524/557

[58] Field of Search ..... 524/442, 443, 261, 262, 524/556, 557

[56] References Cited

U.S. PATENT DOCUMENTS

| | | | |
|---|---|---|---|
| 3,297,616 | 1/1967 | Fisher et al. | 524/442 |
| 4,325,859 | 4/1982 | Blount | 524/442 |
| 4,351,883 | 9/1982 | Marcantonio et al. | 524/442 |

FOREIGN PATENT DOCUMENTS

| | | | |
|---|---|---|---|
| 1943114 | 4/1970 | Fed. Rep. of Germany | 524/442 |
| 857738 | 1/1961 | United Kingdom | 524/442 |

*Primary Examiner*—Allan M. Lieberman
*Attorney, Agent, or Firm*—John J. Freer

[57] ABSTRACT

A coating composite provides desirable corrosion resistance for substrate metals, as well as, enhanced torque control where desired. The undercoat of the composite can be metal in elemental form or can be exemplified by being chromium-containing, either in elemental or non-elemental form. The special topcoat composition, containing copolymer component and silicate substance in liquid medium, is applied directly to the undercoating. In addition to corrosion resistance and torque control, the composite provides the substrate metal with excellent heat, abrasion and solvent resistance. Before use, the special topcoating displays outstanding shelf stability.

8 Claims, No Drawings

CORROSION RESISTANT LUBRICANT COATING COMPOSITE

This is a division, of application Ser. No. 595,055, filed Mar. 30, 1984, now U.S. Pat. No. 4,555,445.

BACKGROUND OF THE INVENTION

It has been known to protect surfaces such as steel surfaces with an elemental metal coating such as a zinc electroplate or galvanized zinc coating. Such zinc surfaces can then be treated by traditional chromate coatings. Also, chromium-containing coating compositions which further contain pulverulent zinc and are substantially resin-free are particularly desirable for providing a substrate such as a ferrous substrate with corrosion resistance.

All such coatings find utility for coating small metal parts, e.g., fasteners and the like and are especially useful in the automotive industry. When such parts are offered to an industry such as the automotive industry, wherein the substrate is protected with a coating composite, a great variety of choice can be manifested. It is, for example, known to coat hexavalent-chromium-containing and pulverulent-zinc-containing undercoatings with silicate topcoatings, as disclosed in U.S. Pat. No. 4,365,003. It is also known in the protection of zinc surfaces such as galvanized sheets, which have been first treated by traditional chromate coating, to topcoat the treated surface with potassium or sodium silicate, as has been discussed in Japanese Patent Disclosure No.: Showa 53-125239. Zinc plated articles can be protected by coating with an aqueous solution of potassium silicate containing an organic dye as has been disclosed in Japanese Patent Disclosure No.: Showa 80-030593. Further to the protection of zinc plate, the silicate solutions can comprise aggressive chemical environments, e.g., containing sulfuric acid and hydrogen peroxide, as discussed for example in U.S. Pat. No. 4,222,779, and nevertheless contain dye as disclosed in U.S. Pat. No. 4,225,350.

In an industry such as the automotive industry where parts can be galvanized or zinc plated or bear chromium and zinc containing coatings, it would be desirable for such parts to not only bear a topcoating but, to also have coating uniformity. It would thus be desirable to have such variety of parts exhibit uniform corrosion and heat resistance, for example, as well as other desirable attributes, especially torque control for fasteners.

SUMMARY OF THE INVENTION

Coating composites have now been achieved with a variety of undercoatings, especially for small metal parts, with the parts displaying desirable coating uniformity. The parts, including metal fasteners such as nuts, bolts, and the like have a smooth finish offering highly desirable torque control, even for finely-threaded fasteners. All such parts bearing a coating composite of the present invention exhibit excellent corrosion and mar resistance as well as heat and solvent resistance. Moreover, a variety of coating colors are now available. When necessary in the subsequent use of the small part, the coating composite can exhibit desirable flexibility. Moreover, the particular novel topcoating used in the present invention exhibits excellent shelf stability along with ease of application and quick cure.

Broadly, the present invention is directed to a coated article of manufacture having a heat resistant and corrosion-resistant coating composite that includes a smooth, uniform topcoating, which article comprises a substrate metal, an undercoating of the composite containing metal in elemental form or containing chromium in non-elemental form, or mixture thereof, and a particulate-metal-free topcoat composition curable to a water resistant coating, with such composition containing liquid medium, copolymer component and silicate substance compatible with the copolymer component in liquid medium.

In another aspect the invention is directed to a smooth, uniform coating composition especially adapted for use as a topcoat composition, the coating composition providing corrosion resistance and enhanced torque control when used as a topcoat composition and being present in cured condition, such composition comprising a particulate-metal-free blend in liquid medium of copolymer component, silicate substance compatible therewith in liquid medium and 0–25 weight percent of coloring agent basis total composition weight.

DESCRIPTION OF THE PREFERRED EMBODIMENTS

The substrate metal for protection is generally a ferrous substrate, which includes alloys of iron, e.g., cast iron, steels such as heat treated and alloyed high strength steels, zinc-iron alloys, and even such as chromized steels and sintered metal substrates, but it can also include other nickel-, cadmium-, cobalt-, and chromium- containing metals and their alloys, such as high strength alloys based on nickel-chromium. Preferably for economy the substrate is a ferrous substrate such as cold rolled steel.

The undercoatings of the coating composite over the substrate metal need not be complex and can be selected from, but not limited to, the elemental metal sacrifical coatings, chromium conversion coatings and hexavalent chromium-providing compositions. Representative elemental metal coatings can include zinc electroplate, aluminized substrates, cadmium electroplate, nickel-zinc electroplate, aluminum electroplate, electro-galvanizing, peen plating, e.g., using zinc or cadmium metals, and hot dipped galvanization. These coatings can provide a protective physical barrier and may have a chrome-containing surface treatment, e.g., a conversion coating of chromium typically prepared from chromic acid. Such coatings form highly adherent microcrystalling coatings on the metal substrate surface. Prior to application of representative undercoatings of this type to the metal substrate, such may be first pretreated, e.g., with a copper metal flash coating or a nickel strike coating. Other surface treatments which contain chromium in non-elemental form and that may be used can however be more simplistic, e.g., a simple chrome rinse. Such chrome-containing surface treatments can be applied over other coatings, including phosphate treatments.

Also of interest in the practice of the present invention are the undercoatings containing chromium in non-elemental form and including such as contain hexavalent chromium-providing substance and pulverulent metal in liquid medium. Such coatings have been disclosed, for example, in U.S. Pat. No. 3,671,331. The preferred hexavalent chromium-providing compositions may contain thickeners, such as water soluble cellulose ethers, as well as contain high boiling organic liquids. The particulate metals of such undercoatings can in general be any suitable electrically conductive metal such as finely divided aluminum, manganese, cadmium, steel, magnesium or zinc. The preferred metals being zinc powder, e.g., atomized and condensed particulates, or zinc flake or aluminum flake or mixtures thereof.

The topcoat of the present invention comprises a blend of components formulated typically in aqueous medium. The components chiefly employed include silicate substance and copolymer component. Advantageously, all of the major topcoat ingredients can be suitably water based for efficiency and economy. However, alternative nonaqueous components can also be used so long as there is no incompatible mixing, e.g., of an aqueous based copolymer component with a nonaqueous based silicate substance, which incompatibility may lead to phase separation after mixing. thus, nonaqueous or "solvent" based copolymers and silicate substances can be useful if on mixing they provide a stable coating composition, and therefore the composition liquid medium can be other than aqueous. For the "aqueous medium" as this term is used herein, such is simply water for economy, but it is to be understood that other liquids not providing phase separation on blending with water, as well as being readily fugitive under topcoat cure conditions, e.g., glycols, may be present. Preferably for best economy and composition stability, an aqueous based copolymer is used with an aqueous based silicate substance. In addition to compatibility of liquid medium for the silicate substance and copolymer component, the term is also used herein to denote harmony of pH between such ingredients when they are water based, as will be discussed in more detail hereinbelow.

The "silicate substance", as the term is used herein, can be organic or water soluble, inorganic silicates, as well as colloidal silicas. The organic silicates that can be, or have been useful include, e.g., ethyl, propyl, butyl and polyethyl silicates, as well as alkoxyl silicates such as ethylene glycol monoethyl silicate, tetra isobutyl silicate and tetra isopropyl silicate and further including aryl silicates such as phenyl silicates. Most generally for economy, the organic silicate is ethyl silicate. The silicates advantageously used in the present invention are the water soluble, inorganic silicates including sodium, potassium, lithium, sodium/lithium combinations, other related combinations, and ammonium including quaternary ammonium, as well as mixtures of the foregoing.

Preferably, for best coating composition stability, mixed systems are avoided. That is, the silicate substance used is one of organic silicate, inorganic silicate, or colloidal silica, but not a mixture of these, it being understood that within one group, e.g., inorganic silicates, mixtures of such inorganic silicates may be useful. With the alkali metal silicates, and referring to sodium silicate as exemplary, the mole ratios of $SiO_2$ to $Na_2O$ will generally be within the range from 1:1 to about 4:1 with the preferred ratio of $SiO_2$:$Na_2O$ being within the range from about 2:1 to 3.8:1. For economy, an aqueous based sodium silicate is used for the preferred embodiment. Such preferred silicate can typically have a pH on the order of about 12 or so.

Since such silicates are typically available as water solutions, the term "silicate substance" is used herein also for the convenience of denoting such combinations. Thus, the "silicate substance" as the term is used herein can impart both silicate and liquid medium to the coating composition of the present invention. Although the use of solid silicates in the preparation of the coating composition is contemplated, the silicate substance will most always be a liquid medium containing from at least 0.5 weight percent solids, and may contain up to about 50 weight percent solids or more. Advantageously, for efficiency in achieving desirable coating properties, the silicate substance will contain at least 1 weight percent solids. It is preferred that the silicate substance contain above about 5 weight percent solids up to abut 40 weight percent.

The silicate substance will most always contribute from about 2 to 25 weight percent of solids to the total coating composition. Less than about 2 weight percent can be insufficient for providing enhanced corrosion resistance of the cured topcoating while greater than 25 weight percent can lead to viscous compositions that are difficult to apply. Advantageously for best ease of application plus desirable topcoating corrosion resistance, the coating composition will contain from about 5 to about 20 percent by weight of silicate substance.

The composition will also contain a copolymer component. Although the simple use of a solid copolymer component in the preparation of the coating composition is contemplated, the use of a copolymer dispersion in liquid medium, such as are generally commercially available, will be more typical. Hence, the term "copolymer component" as such is used herein, is meant to denote the potential combination of copolymer plus liquid medium. Such a component will generally contain from about 20 to about 70 percent by weight solids. Although other liquids may be useful, the liquid for the copolymer component medium will most usually be an aqueous medium, and simply water for economy. The copolymer component as a dispersion may include some partial solution of copolymer in the liquid medium dispersion, but for economy will also include components which may be an aqueous emulsion. Especially when a commercially available copolymer component is selected, such may include additives, e.g., emulsion stabilizer. The copolymer of the copolymer component is advantageously such having a melting point above about 50° C., to avoid fugitive loss of copolymer under heat curing conditions. Moreover, for efficient torque control of coated threaded articles, the copolymer used is most suitably a polyethylene-containing copolymer and preferably for torque control and economy, the copolymer component is an emulsion of a polyethylene-containing copolymer in water.

As has been mentioned hereinabove, the copolymer component is advantageously a water-based component for economy, and also as mentioned hereinabove most suitably finds use with a water-based silicate substance. For these aqueous compositions of the present invention, it is necessary that they have compatible pH. By this, for example, it is meant that for the alkaline silicate substances having a pH in aqueous medium of above 7, a copolymer component should be selected that likewise is alkaline and has a pH in aqueous medium of above 7. Generally such compatible copolymer component will have a pH within the range from about 7.5 to about 10 or more and thereby provide with the silicate substance a coating composition of enhanced stability against gellation. On the other hand, acidic aqueous colloidal silicas are more advantageously blended with acidic copolymer components.

The copolymer component will most always contribute from about 0.25 to about 25 weight percent of copolymer solids, basis total composition weight, to the coating composition. An amount of less than about 0.25 weight percent of such solids can provide for an undesirably high balance of liquid medium. On the other hand, greater than about 25 weight percent of such solids can yield compositions which are highly viscous and difficult to apply. For best coating efficiency combined with desirable composition viscosity, the coating composition will preferably contain from about 5 to about 20 percent by weight of copolymer solids. Representative copolymers for contributing to the copolymer component include ethylene acrylic acid copolymers and ethylene vinyl acetate copolymers.

The composition may also contain a wax component, e.g., a microwax. Suitable waxes for the wax component are naturally occurring waxes such as paraffin waxes extracted from lignite or peat. Other waxes are the synthetic waxes obtained principally from mineral source raw materials, e.g., low molecular weight polymers of ethylene (some of which may be partly oxidized) and esters of the montanic acids ($C_{26}$ to $C_{32}$ monocarboxylic aliphatic acids) including e.g., diesters of same with polyfunctional alcohols. Also, there can be included the amide or ester type waxes of various fatty acids or mixed fatty acids (including those derived from vegetable oils or animal fats), e.g., carnauba erucamide.

Although the simple use of a solid wax in the preparation of the coating composition is contemplated, the use of a wax dispersion in liquid medium, such as are generally commercially available, will be more typical. Hence, the term "wax component" as such is used herein, is meant to denote the potential combination of wax plus liquid medium. Although other liquids may be useful, the liquid for the wax component medium will most usually be an aqueous medium, and simply water for economy. The wax component as a dispersion may include at least partial solution of wax in liquid medium, but for economy will preferably be an aqueous emulsion. The emulsions can contain additives which may include constituents such as emulsion stabilizer that may also serve as a pH adjuster, as well as contain preservative and surface active agent. The wax of the wax component is advantageously such having a melting point above about 50° C., to avoid fugitive loss of wax under heat curing conditions. Moreover, for efficient torque control of coated threaded articles, the wax used is most suitably a synthetic wax and preferably for torque control and economy, the wax component is an emulsion of synthetic wax in water.

As has been mentioned hereinabove, the wax component is advantageously a water-based component for economy, and also as mentioned hereinabove most suitably finds use with a water-based silicate substance. For these aqueous compositions of the present invention, it is necessary that they have compatible pH in the same manner as has been discussed for the copolymer component. Thus for use with the alkaline silicate substances, generally such compatible wax component will have a pH within the range from about 7.5 to about 10 or more.

The wax component will most always contribute from about 0.25 to about 25 weight percent of wax solids, basis total composition weight, to the coating composition. An amount of less than about 0.25 weight percent of such solids can provide for an undesirably high balance of liquid medium. On the other hand, greater than about 25 weight percent of such solids can yield compositions which are highly viscous and difficult to apply. When a wax component is used for best coating coating efficiency with desirable composition viscosity, the coating composition will preferably contain from about 5 to about 20 percent by weight of wax solids.

The coating composition can also contain coloring agent, including liquid and/or solid such agents. These agents should be able to withstand the topcoat elevated temperature cure conditions, typically on the order of at least about 200° F. or more. It is also necessary that such agents not leach from the cured topcoating under moist conditions such as under exposure to high humidity. Suitable such agents that are cure-stable, as well as, leach resistant include the particulate pigments, e.g., titanium dioxide and calcium carbonate. Other useful coloring agents include dyes, such as axo dyes.

The coloring agent may contribute up to about 25 weight percent of solids to the coating composition basis total composition weight. Greater than about 25 weight percent of pigment can yield thick, viscous compositions which are difficult to apply. For best ease of application plus hiding power of the cured film, the coloring agent will advantageously contribute from about 0.5 to about 10 weight percent of agent to the total composition weight.

It is contemplated that the topcoating composition will almost always also include a surface active agent, or "wetting" agent, and may also include a defoaming agent as a formulation aid. The defoaming agent will typically be used when incorporating particulate pigment into composition medium. Suitable defoaming agents which can be used include mixtures of olefinic solids in parafinic liquid carrier. Generally only from about 0.2 to about 2 weight percent, basis total formulation weight, of defoaming agent is present in the composition. The wetting agent, or surface active agent, is also present in minor amount. Suitable such agents are the anionic and nonionic types. Typically, the concentration of wetting agent ranges from about 0.05 to 0.5 weight percent of the total formulation, although more usually from about 0.1 to about 0.3 weight percent of such surface active agent is present. Suitable wetting agents include salts, e.g., sodium salts, of polymeric carboxylic acids as well as agents that are mixtures of polyols of ethylene oxide with hydrophobic bases.

As mentioned hereinabove, the composition medium will most typically be an aqueous medium, that can be supplied by an aqueous copolymer component and aqueous silicate substance. However, solvent systems, e.g., low molecular weight alcohols such as ethanol and isopropanol, as well as others including ethylene glycol monoethyl ether and mixtures containing xylene, toluene and the like, can also be employed. The addition of further liquid, e.g., the use of added water to a concentrated aqueous composition made up from aqueous based components, may be useful for providing a final composition which can be more readily applied. Moreover, the composition may also contain further ingredients such as thickeners and fillers including clay and talc. Thickeners of particular interest include such as those based on xanthan gum. It has been found particularly desirable in the preparation of the coating composition to dilute viscous ingredients, e.g., silicate substance solutions, for ease of make up of the coating composition. Thereafter, elevated composition viscosity for enhanced film buildup can be desirably achieved by thickener addition in only very minor mount. Ingredients for enhancing corrosion protection may be present in the composition, but should be present in only very minor amounts. Thus, the topcoating is substantially chromium-free, i.e., an aggregate amount of no more than about one weight percent of the topcoating should be contributed by soluble chromates, chromic acid or its equivalents, and preferably the composition is chromium-free. Moreover, the topcoating should be free from particulate metal, e.g., in flake or powder form.

The topcoat composition is capable of air drying at room temperature to a tack-free condition, but must be cured for providing a water-resistant and corrosion-resistant topcoating. Curing can be achieved by baking, e.g., at elevated temperatures. It is typical to select the curing conditions in accordance with the particular silicate substance used. For example, lower cure temperatures on the other of about 150° F. to about 300° F. will be useful for the colloidal silicas and organic silicates. For the inorganic silicates, curing typically takes place at a temperature on the order of about 300° F. to about 500° F. Thus, in general, cure temperatures on the order of from about 150° F. to about 500° F. are useful. Cure temperatures reaching above about 500° F. are uneconomical and undesirable. For best coating performance, the topcoat of the present invention is typically curred at temperatures within the range from about 200° F. to about 500° F. and preferably at a temperature from about 300° F. to about 450° F.

The topcoating may be applied by various techniques including brush, roller or conventional or electrostatic spray coating as well as the preferred immersion techniques including "dip drain" and "dip spin" techniques. Dip drain is accomplished by simply immersing the substrate into the coating and letting the excess drain off. Dip spin is achieved by placing the parts to be coated in a basket and dipping same into the coating. The excess coating is removed by rapidly rotating the coated parts maintained in the basket. Articles can be topcoated that are at elevated temperature, as from curing of the preferred undercoating, by a procedure such as dip spin, dip drain, dip drain and spin or spray coat. By such operation, some to all of the topcoat curing is achieved without further heating.

The topcoat should be present in an amount above about 50 milligrams per square foot of coated substrate. For economy, topcoat weights for the cured topcoating will not exceed about 5,000 milligrams per square foot. Preferably, for best efficiency and economy, the topcoat is present in the range from about 200 to about 3,000 milligrams per square foot of coated substrate.

The following example will serve to further illustrate the operation and advantages of the present invention. The example should not be considered, however, as a limitation upon the scope of the present invention.

Preparation of Test Parts

Test parts are typically prepared for coating by first immersing in water which has incorporated therein 2 to 5 ounces of cleaning solution per gallon of water. The alkaline cleaning solution is a commercially available material of typically a relatively major amount of weight of sodium hydroxide with a relatively minor weight amount of a water-softening phosphate. The bath is maintained at a temperature of about 150° to 180° F. Thereafter, the test parts are scrubbed with a cleaning pad which is a porous, fibrous pad of synthetic fiber impregnated with an abrasive. After the cleaning treatment, the parts are rinsed with warm water and may be dried.

Application of Coating to Test Parts and Coating Weight

Unless otherwise described in the example, clean parts are typically coated by dipping into coating composition, removing and draining excess composition therefrom, sometimes with a mild shaking action, and then immediately baking or air drying, at room temperature until the coating is dry to the touch and then baking. Baking proceeds in a hot air convection oven at temperatures and with times as specified in the example.

Coating weights for parts, generally expressed as a weight per unit of surface area, are typically determined by selecting a random sampling of parts of a known surface area and weighing the sample before coating. After the sample has been coated, it is reweighed and the coating weight per selected unit of surface area, most always presented as milligrams per square foot (mg./sq.ft.), is arrived at by straightforward calculation.

Corrosion Resistance Test (ASTM B117-73) and Rating

Corrosion resistance of coated parts is measured by means of the standard salt spray (fog) test for paints and varnishes ASTM B117-73. In this test, the parts are placed in a chamber kept at constant temperature where they are exposed to a fine spray (fog) of a 5 percent salt solution for specified periods of time, rinsed in water and dried. The extent of corrosion on the test parts is determined by comparing parts one with another, and all by visual inspection.

EXAMPLE

Basecoat

To 55 millileters (mls.) of dipropylene glycol (DPG), there was blended with moderate agitation 1.0 ml. of a nonionic wetter having a viscosity in centipoises at 25° C. of 280 and a density at 25° C. of 10 pounds per gallon, and 1.0 gram (gm.) of hydroxypropyl methyl cellulose thickener. The thickener is a very finely-divided cream to white colored powder. To this thickener mixture there was then added 84 gms. of a flaked zinc/aluminum mixture, providing 75.5 gms. zinc and 8.5 gms. aluminum, using agitation during the addition. The zinc flake has particle thickness of about 0.1 to 0.5 micron and a longest dimension of discrete particles of about 80 microns.

Separately there was added to 88 mls. of deionized water 12.5 gms. of $CoO_3$, and to this there was added an additional 88 mls. of deionized water. To this chromic acid solution there was added about 3 gms. of zinc oxide. The resulting chromic acid solution was slowly added to the metal flake dispersion to form a basecoating composition.

Topcoat

For a topcoat composition there was added to 150 gms. of aqueous acrylic polyethylene copolymer dispersion resin having a viscosity in centipoises at 25° C. of 100 to 200, a pH of 9 to 10 and a solids content of 25 to 35 percent by weight, 2.5 gms. of a defoaming agent, which is a light tan liquid having a specific gravity at 25° C. of 0.845 and a viscosity at 25° C. of 800 centipoises. This mixture was then mixed for 5 minutes with moderate, low shear mechanical agitation.

Separately there was prepared a solution of commercially available sodium silicate, having a 40 weight percent solids content in aqueous medium and a ratio of $SiO_2$:$NA_2O$ of 3.22, by diluting the sodium silicate at 1:1 ratio, by weight, with water. There resulted a 20 percent sodium silicate solution. This silicate solution is combined with the copolymer dispersion and defoaming agent blend to prepare the topcoat composition.

The parts for testing were commercially available 1½ inch electrozinc plated 9.8 grade hex bolts. As noted in the table below some of the parts had received a dichromate treatment by the manufacturer. Some of the parts were basecoated as described hereinbefore and then cured at an oven temperature of 575° F. Topcoating was performed on some parts, as noted in the table below, and was handled as described with topcoat curing by baking at an oven temperature of 350° F. for ten minutes. Coated parts were then subjected to the hereinabove described corrosion resistance test. Results are reported in the table below, compared against controls having no topcoating.

TABLE

| Test Part | Salt Spray | |
|---|---|---|
| | % Red Rust | Test Hours |
| Zinc Plate | 26 | 48 |
| Zinc Plate/Topcoat | 11 | 168 |
| Zinc Plate/Dichromate | 33 | 168 |
| Zinc Plate/Dichromate/Topcoat | 22 | 552 |
| Zinc Plate/Basecoat | 4 | 336 |
| Zinc Plate/Basecoat/Topcoat | 2 | 1728 |

What is claimed is:

1. A smooth, uniform coating composition especially adapted for use as a topcoat composition on coated metal substrates, said coating composition providing corrosion resistance and enhanced torque control as a topcoat composition in heat cured condition, said coating composition comprising a particulate-metal-free blend in liquid medium of from about 0.25 to about 25 weight percent of polyethylene-containing copolymer dispersion components comprising an ethylene copolymer resin, from about 2 to about 25 weight percent silicate substance compatible in pH with said copolymer component in liquid medium without phase separation, and 0–25 weight percent of cure-stable, leach resistant coloring agent, basis total composition weight, wherein said copolymer of the copolymer dispersion component has a melting point above 50° C.

2. The coating composition of claim 1 wherein said copolymer component is an aqueous copolymer emulsion and said silicate substance compatible with said copolymer component is in aqueous medium.

3. The coating composition of claim 2 wherein said copolymer component is an aqueous copolymer emulsion having a pH of greater than 7 and said silicate substance is an alkali metal silicate in aqueous medium and has a pH of greater than 7.

4. The coating composition of claim 2 wherein said copolymer component contains from about 20 to about 70 percent by weight solids.

5. The coating composition of claim 1 wherein said silicate substance is selected from the group consisting of alkali metal silicate, ammonium silicate, organic silicates, colloidal silicas and mixtures thereof.

6. The coating composition of claim 1 further characterized by containing from about 0.05 to 0.5 percent by weight of anionic or nonionic wetting agent, basis total composition weight.

7. The coating composition of claim 6 wherein said wetting agent comprises a polyol of ethylene oxide mixed with hydrophobic bases.

8. The coating composition of claim 1 further characterized by being substantially chromium-free and heat-curable.

* * * * *